US006871795B2

(12) United States Patent
Anuskiewicz

(10) Patent No.: US 6,871,795 B2
(45) Date of Patent: Mar. 29, 2005

(54) IRRIGATION SPRINKLER WITH EASY REMOVAL NOZZLE

(75) Inventor: Ronald H. Anuskiewicz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 76 days.

(21) Appl. No.: 10/366,857

(22) Filed: Feb. 13, 2003

(65) Prior Publication Data

US 2004/0195400 A1 Oct. 7, 2004

(51) Int. Cl.[7] ..... B67D 5/38

(52) U.S. Cl. ..... 239/74; 239/203; 239/206; 239/263; 239/390; 239/600

(58) Field of Search ..... 239/71, 74, 201, 239/203, 204, 205, 206, 263, 390, 391, 600

(56) References Cited

U.S. PATENT DOCUMENTS

| | | | | |
|---|---|---|---|---|
| 5,226,599 A | * | 7/1993 | Lindermeir et al. | 239/205 |
| 5,456,411 A | * | 10/1995 | Scott et al. | 239/73 |
| 5,699,962 A | * | 12/1997 | Scott et al. | 239/73 |
| 6,095,432 A | * | 8/2000 | Casagrande | 239/230 |
| 6,216,959 B1 | * | 4/2001 | Garrison et al. | 239/1 |
| 6,234,411 B1 | * | 5/2001 | Walker et al. | 239/289 |
| 6,502,764 B2 | * | 1/2003 | Walker | 239/203 |
| 6,601,781 B2 | * | 8/2003 | Kah et al. | 239/391 |
| 6,732,950 B2 | * | 5/2004 | Ingham et al. | 239/205 |
| 2002/0074432 A1 | * | 6/2002 | Kah et al. | 239/243 |

OTHER PUBLICATIONS

Photograph of Rain Bird 3500 Series Removable Rotor Nozzle.

Photograph of Rain Bird Falcon 6504 Removable Rotor Nozzle.

Photograph of K–Rain K–1 Removable Rotor Nozzle.

"3500 Series, Easy to Use, Tough to Beat" Part–Circle Rotor Pop–Up Sprinklers. Rain Bird Rotors 2001 Catalog, p. 49.

"Falcon 6504, Uncompromising Performance" Full–or Part–Circle Rotor Pop–Up Sprinklers, Rain Bird Rotors 2001 Catalog, p. 69.

* cited by examiner

*Primary Examiner*—Chrsitopher Kim
(74) *Attorney, Agent, or Firm*—Michael H. Jester

(57) ABSTRACT

An irrigation sprinkler includes a head having a first water outlet passage that communicates with a nozzle receiving socket. A nozzle is slidably mounted in the nozzle receiving socket. The nozzle includes a hollow support body defining a second water outlet passage that communicates with the first water outlet passage. The nozzle also includes a portion obstructing the second water passage and defining a nozzle orifice. The nozzle also includes a cantilevered pry flange that extends in a lateral direction from an outer end of the support body. The pry flange has a portion that terminates short of a wall of the nozzle receiving socket to create a gap sized for ready insertion of a tool to facilitate removal of the nozzle from the nozzle receiving socket. The sprinkler includes conventional structure for supplying the first water outlet passage of the head with pressurized water.

16 Claims, 6 Drawing Sheets

IRRIGATION SPRINKLER WITH EASY REMOVAL NOZZLE

FIELD OF THE INVENTION

The present invention relates to sprinklers that distribute water over turf and other landscaping, and more specifically, to sprinklers with removable nozzles.

BACKGROUND OF THE INVENTION

Rotor type sprinklers have largely displaced older impact type sprinklers in applications where large expanses of grass are watered, such as golf courses, due to the fact that the former are more reliable, quieter, and distribute water on a uniform and controlled basis. Typically a rotor type sprinkler includes an outer housing that supports and encloses a telescoping pop-up riser. A cylindrical head or turret at the upper end of the riser includes a nozzle that shoots out an inclined stream of water over a range of sixty feet or more depending upon the available water pressure. A rotor type sprinkler also typically includes a turbine that drives the head through a gear reduction mechanism. The head and its internal nozzle rotate at a relatively slow rate about a vertical axis. An adjustable reversing mechanism causes the head to oscillate so that the stream of water is ejected over a predetermined arc. An adjustable stream deflector may be mounted in the head in the form of a threaded screw that can be moved into and out of the water stream to affect the radius (distance of coverage) and spray pattern.

An ideal irrigation system for turf and landscaping should utilize a minimum number of valves, supply lines and sprinklers. Preferably the valves should be turned ON and OFF by an inexpensive, yet reliable electronic irrigation controller that is easy to program and can carry out a wide variety of watering schedules. The goal is to uniformly distribute the optimum amount of water over a given area. When an irrigation system is designed and/or installed the precipitation rates for each of the sprinklers are pre-selected, usually in terms of gallons per minute (GPM) of precipitation. The radius or distance that the stream of water ejected is also pre-selected. The optimum precipitation rate provided by each sprinkler should preferably fall within plus or minus one-quarter GPM. The precipitation rate and radius of a rotor type sprinkler are largely determined by the size and configuration of its nozzle orifice, although variations result from fluctuations in water pressure that cannot be fully negated with regulators.

Attempts have been made to develop and manufacture rotor type sprinklers with multiple nozzles that can be rotated in place over an exit flow path to select precipitation rates and radii. For example, U.S. Pat. No. 5,765,757 of Bendall entitled QUICK SELECT NOZZLE SYSTEM, which is assigned to Hunter Industries, Inc., the assignee of the subject application, discloses a rotor type sprinkler with a generally circular nozzle plate having a plurality of different nozzle orifices that is rotatably mounted in the head of the sprinkler. A pinion gear in the head of the sprinkler can be engages with a standard HUNTER® sprinkler adjustment tool or a screwdriver. The pinion gear has teeth that mesh with teeth on the periphery of the nozzle plate. Rotation of the pinion gear causes the nozzle plate to rotate to place a selected orifice of its nozzle plate in alignment with a water flow outlet passage in the head. U.S. Pat. No. 5,826,797 of Kah, III entitled OPERATIONALLY CHANGEABLE MULTIPLE NOZZLES SPRINKLER, discloses an irrigation sprinkler in which a cylindrical sleeve having multiple circumferentially spaced nozzle orifices that can be manually rotated to place a selected one of the nozzle orifices in alignment with a flow passage. An alternate embodiment disclosed in the '797 Kah, III patent uses a vertically sliding nozzle plate that can be removed and replaced. In commercializing the sprinklers of the aforementioned '757 Bendall patent and the '797 Kah, III patent it has turned out to be very difficult to provide a satisfactory water tight seal between the moving structure that contains the multiple nozzle orifices and the stationary structure that defines the water flow outlet passage.

Many rotor type irrigation sprinklers have replaceable nozzles that have a standard outer configuration but different orifice sizes that provide different rates of precipitation and different radii. The nozzle is typically made of injection molded plastic and is received in a conformably shaped socket in the injection molded head. The nozzle is held in place due to tight tolerances, and in some cases, a projection and detent are used to provide a snap fit. In rotor type sprinklers sold by Hunter Industries, Inc., the stream deflector may be screwed down to prevent the nozzle from coming out of its socket. When a user desires to change the nozzle to vary the precipitation rate or radius of a rotor type sprinkler, he or she often uses a pair of pliers to grip and withdraw the nozzle, or a screwdriver to pry the nozzle out of its socket, sometimes resulting in damage to the nozzle and/or its socket.

U.S. Pat. No. 5,456,411 of Loren W. Scott et al. entitled QUICK SNAP NOZZLE SYSTEM, which is also assigned to Hunter Industries, Inc., discloses a rotor type sprinkler with a removable nozzle that includes an indicia tab that extends vertically from the outer end of the nozzle. The tab extends to a position on top of the sprinkler turret where it may be folded back to a horizontal orientation and latched into a tab recess so that it is visible at all times. The tab can be unlatched and gripped with a pair of pliers to remove the nozzle but this can be tedious.

U.S. Pat. No. 5,699,962 of Loren W. Scott et al. entitled AUTOMATIC ENGAGEMENT NOZZLE, which is also assigned to Hunter Industries, Inc., discloses a variation of the aforementioned quick snap nozzle system in which the nozzle is biased within the socket, forcing it to tilt relative to a socket axis into latching engagement.

While the aforementioned patented removable nozzle systems of U.S. Pat. Nos. 5,456,411 and 5,699,962 have been successfully commercialized by Hunter Industries, Inc., they still require a user to have a pair of needle nose or other suitable pliers available for gripping the tab in order to remove the nozzle. Users that do not have a pair of pliers readily available have been known to insert a screwdriver or other small tool in the nozzle orifice or into the tiny slit or space between the cylindrical outer wall of the nozzle and the facing cylindrical wall of the nozzle socket in an attempt to remove the nozzle. This is tedious and often damages the nozzle and/or the nozzle socket. If the nozzle is damaged too severely it cannot be reused. If the nozzle socket is damaged too severely, the entire rotor has to be replaced.

SUMMARY OF THE INVENTION

Accordingly, it would be desirable to provide an irrigation sprinkler with a nozzle that is more easy to remove and replace without risking damage to the nozzle itself or its surrounding socket.

In accordance with my invention an irrigation sprinkler includes a head having a first water outlet passage that communicates with a nozzle receiving socket. A nozzle is slidably mounted in the nozzle receiving socket. The nozzle includes a hollow support body defining a second water outlet passage that communicates with the first water outlet passage. The nozzle also includes a portion defining a nozzle orifice. The nozzle also includes a cantilevered pry flange that extends in a lateral direction from an outer end of the support body. The pry flange has a portion that terminates short of a wall of the nozzle receiving socket to create a gap sized for ready insertion of a tool to facilitate removal of the nozzle from the nozzle receiving socket. The sprinkler includes conventional structure for supplying the first water outlet passage of the head with pressurized water.

My invention also provides an easy removal nozzle for an irrigation sprinkler having a head with a first water outlet passage communicating with a nozzle receiving socket. The nozzle includes a hollow support body configured to be slidably mounted in the nozzle receiving socket and defining a second water outlet passage communicating with the first water outlet passage. A wall portion of the nozzle obstructs the second water passage and defines a nozzle orifice. A cantilevered pry flange extends in a lateral direction from an outer end of the support body and has a portion terminating short of a wall of the nozzle receiving socket to create a gap sized for ready insertion of a tool to facilitate removal of the nozzle from the nozzle receiving socket.

DESCRIPTION OF THE PREFERRED EMBODIMENTS

Figure 1:
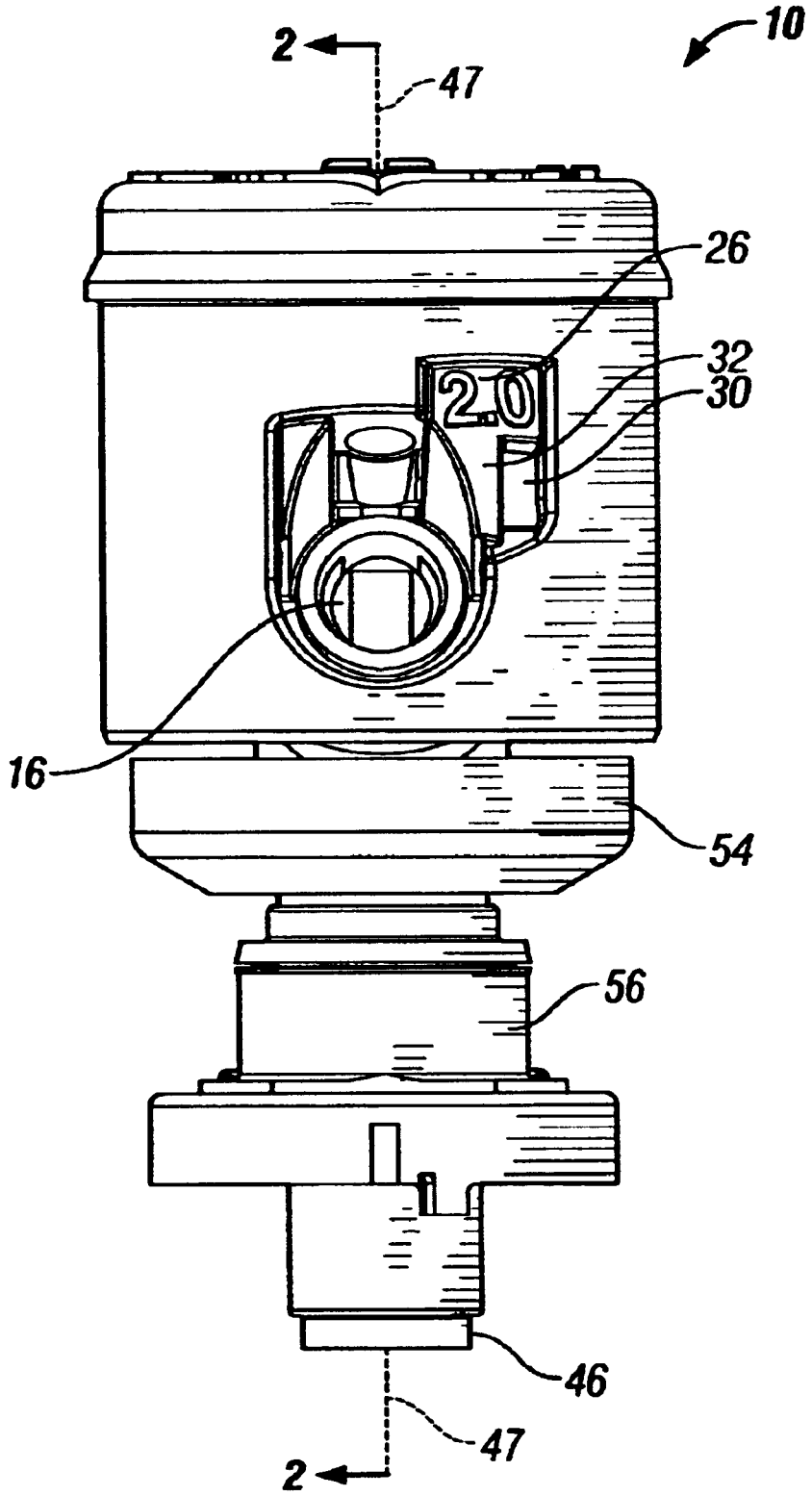
FIG. 1 is a side elevation view of the head of a sprinkler with an easy removal nozzle mounted therein.
Figure 2:
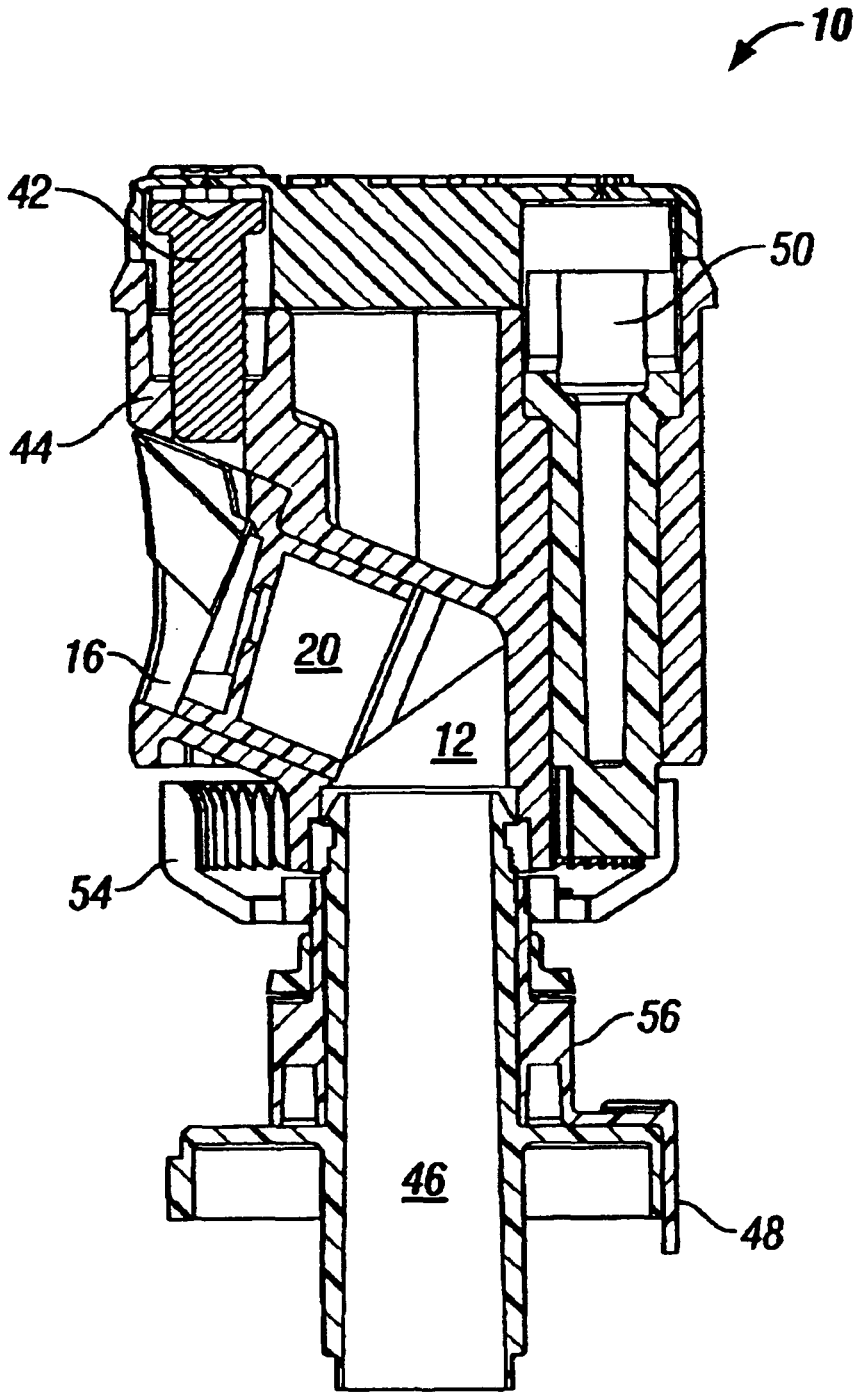
FIG. 2 is a vertical sectional view of the sprinkler head and nozzle of FIG. 1 taken along line 2—2 of FIG. 1.
Figure 3:
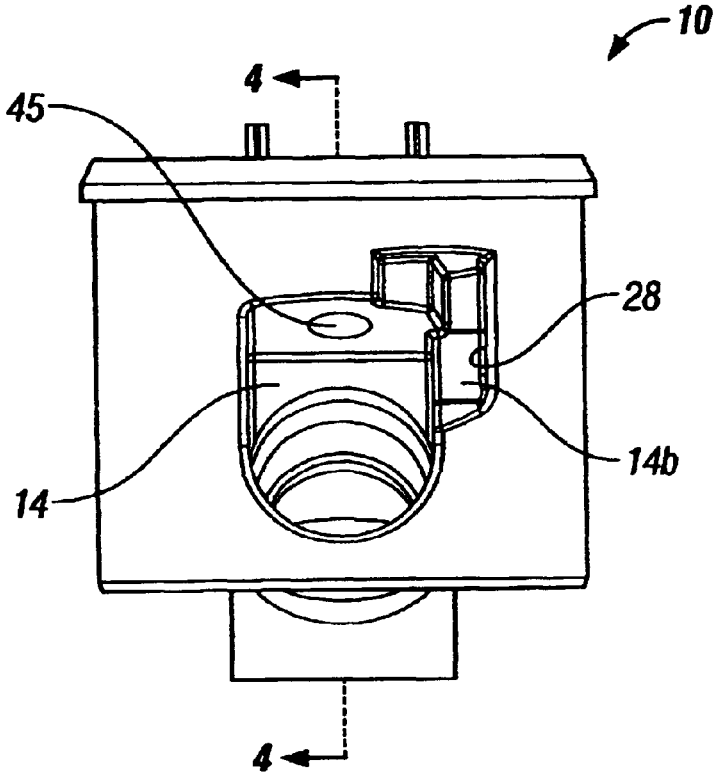
FIG. 3 is a side elevation view of the head with the nozzle removed from its nozzle receiving socket.
Figure 4:
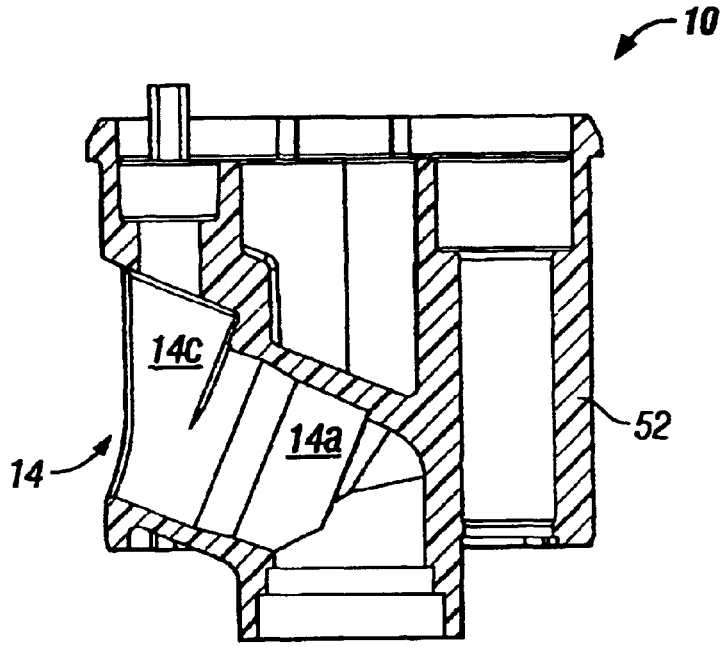
FIG. 4 is a vertical sectional view of the head without the nozzle taken along line 4—4 of FIG. 3.
Figure 5:
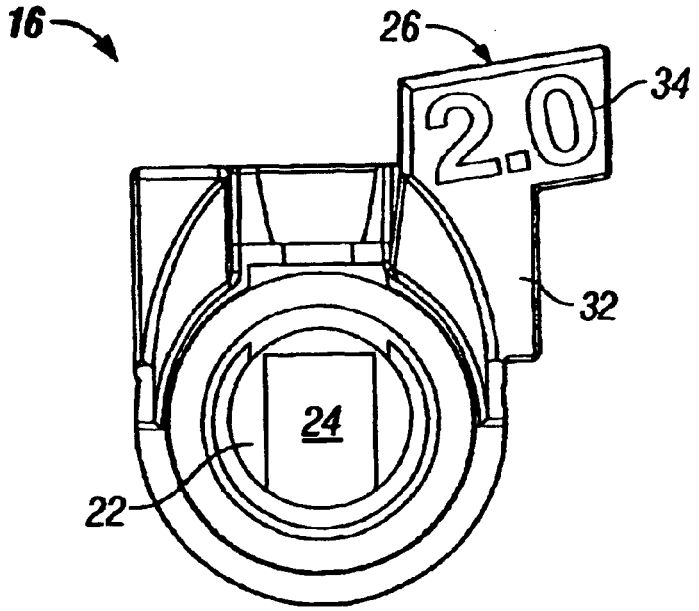
FIG. 5 is an enlarged front end elevation view of the nozzle removed from the nozzle receiving socket of the head.
Figure 6:
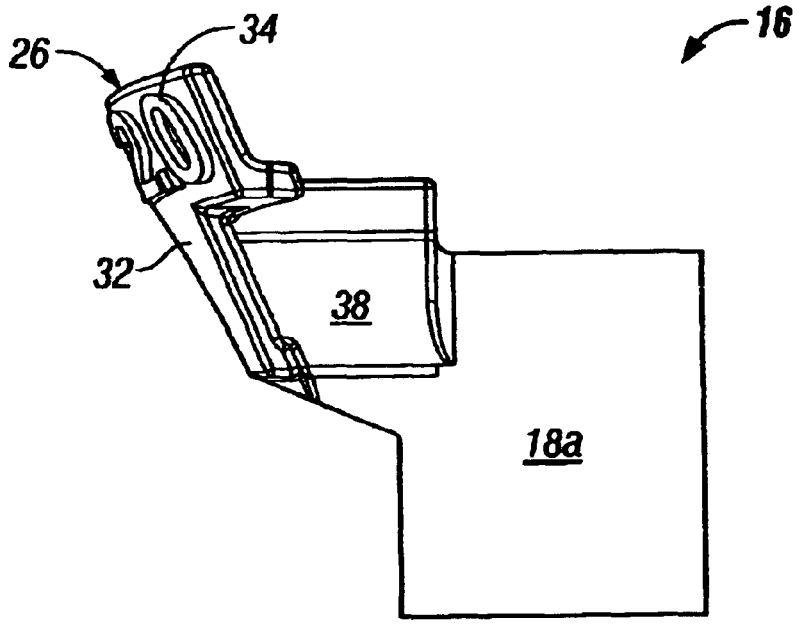
FIG. 6 is a side elevation view of the nozzle taken from the right side of FIG. 5.
Figure 7:
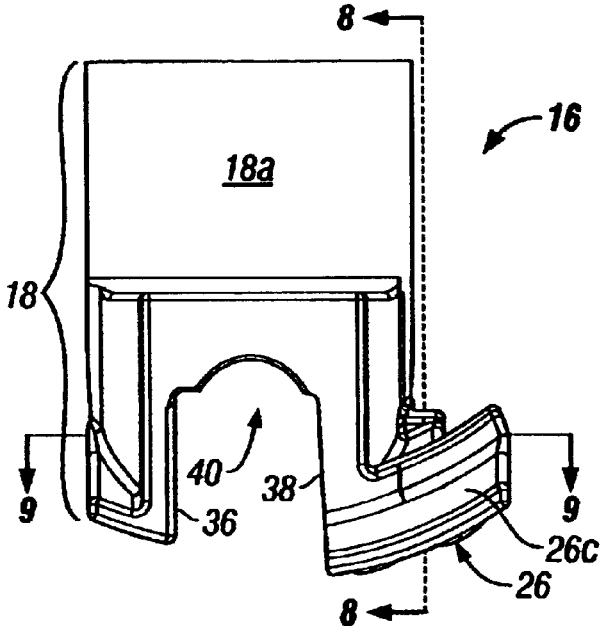
FIG. 7 is a top plan view of the nozzle taken from the top of FIG. 5.

In accordance with a preferred embodiment of the present invention a generally cylindrical head 10 (FIG. 1) has a dog-legged water outlet passage 12 (FIG. 2) that communicates with nozzle receiving socket 14 (FIG. 3). A nozzle 16 (FIGS. 5 and 6) is slidably mounted in the nozzle receiving socket 14 as illustrated in FIG. 2. The nozzle 16 includes a hollow support body 18 (FIG. 7) having a hollow cylindrical portion 18*a* defining a water outlet passage 20 that communicates with the water outlet passage 12. The nozzle receiving socket 14 has an inner cylindrical segment 14*a* (FIG. 4) with a complementary shape for snugly receiving the cylindrical portion 18*a* of the support body 18. The nozzle 16 also includes a portion in the form of a flat wall 22 (FIG. 5) that obstructs the water outlet passage 20 and defines a rectangular nozzle orifice 24.

The head 10 is preferably injection molded as a single unitary piece of black plastic that includes ultraviolet resisting agents. The nozzle 16 is also preferably injection molded as single unitary piece of a bright colored plastic such as red, green, blue, yellow, orange, etc., each color being associated with a particular precipitation rate and/or radius. Each different color indicates that the particular version of the nozzle 16 has a different size and/or configuration for the nozzle orifice 24. Preferably the user is provided with a plastic tree of multi-color nozzles of different precipitation rates that can be individually broken off from the tree for installation into a sprinkler. See U.S. Pat. No. 5,868,316 of Loren W. Scott entitled MULTI-COLOR NOZZLE RACK AND METHOD FOR MAKING SAME, also assigned to Hunter Industries, Inc., the entire disclosure of which is hereby incorporated by reference. The aforementioned '316 Scott patent discloses a system of multi-colored nozzles that are simultaneously molded in a multi-cavity mold and emerge from the mold in an interconnected rack of multi-colored nozzles with common flow characteristics denoted by the corresponding applicable color of the plastic from which they have been injection molded.

The nozzle 16 also includes a cantilevered pry flange 26 (FIGS. 1, 5 and 7) that extends in a lateral direction (relative to a central longitudinal axis of the cylindrical portion 18*a* of the support body 18) from an outer end of the support body 18. The pry flange 26 also extends in a circumferential direction relative to the outer circumference of the cylindrical head 10. A lower portion 32 (FIG. 5) of the pry flange 26 terminates short of a side wall 28 (FIG. 3) of the nozzle receiving socket 14 to create a vertical rectangular gap 30 (FIG. 1) sized for ready insertion of the end of the hexagonal steel rod of a HUNTER tool (wrench) or some other tool such as a flat bladed screwdriver to facilitate removal of the nozzle 16 from the nozzle receiving socket 14. The HUNTER tool is described in detail in U.S. Pat. No. 6,042,021 of Mike Clark entitled ARC ADJUSTMENT TOOL LOCKING MECHANISM FOR POP-UP ROTARY SPRINKLER, which is also assigned to Hunter Industries, Inc., the entire disclosure of which is hereby incorporated by reference.

Figure 9:
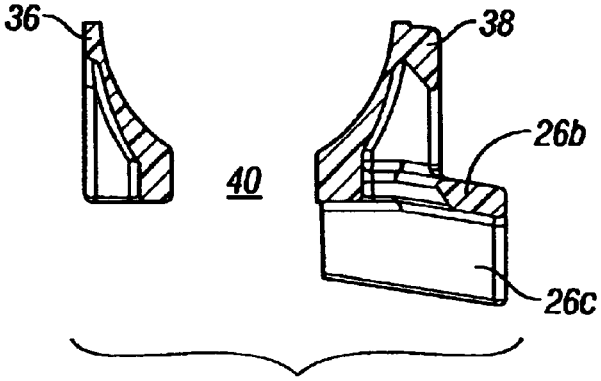
FIG. 9 is a cross-sectional view of the nozzle taken along line 9—9 of FIG. 7 illustrating further details thereof.

The pry flange 26 has an upper portion 34 (FIG. 5) with a curved exterior surface bearing molded indicia representing a precipitation rate, in this case "2.0" which represents two gallons per minute (GPM). The precipitation rate is determined primarily by the size of the nozzle orifice 24. The nozzle receiving socket 14 has a segment 14*b* (FIG. 3) with a generally L-shaped configuration complementary to the pry flange 26 for receiving and surrounding the pry flange 26. The support body 18 includes a pair of spaced apart stabilizing arms 36 and 38 (FIGS. 7 and 9) that extend in a forward direction from opposite sides of the cylindrical portion 18*a* of the support body 18 and define a recess 40 therebetween for receiving the lower end of a screw 42 (FIG. 2) that holds the nozzle 16 in the nozzle receiving socket 14.

The pry flange 26 (FIG. 5) is cantilevered in the sense that only the inner end thereof is integrally molded to any other part, which in this case is the stabilizing arm 38 of the support body 18. The outer end of the pry flange 26 is not integrally molded to a secondary nozzle, to the other stabilizing arm 36, or to any other parts of the nozzle 16. The term "integrally molded" as used herein refers to the process of injection molding a structure, such as the nozzle 16, as a single unitary piece of plastic.

The upper end of the screw 42 (FIG. 2), which is preferably made of stainless steel, has a hexagonal socket (not visible) for receiving the end of the hexagonal rod of the HUNTER tool for threading the screw up and down in a female threaded sleeve portion 44 of the head 10. The lower end of screw 42 can be screwed through a hole 45 (FIG. 3) in the upper part of the socket 14 and thereby positioned to intercept the stream of water ejected from the nozzle orifice 24 to ensure that turf or other vegetation near the nozzle receives water. The upper end of the screw 42 also preferably has a diametrically extending slot (also not visible) for receiving a flat bladed screw driver.

Figure 8:
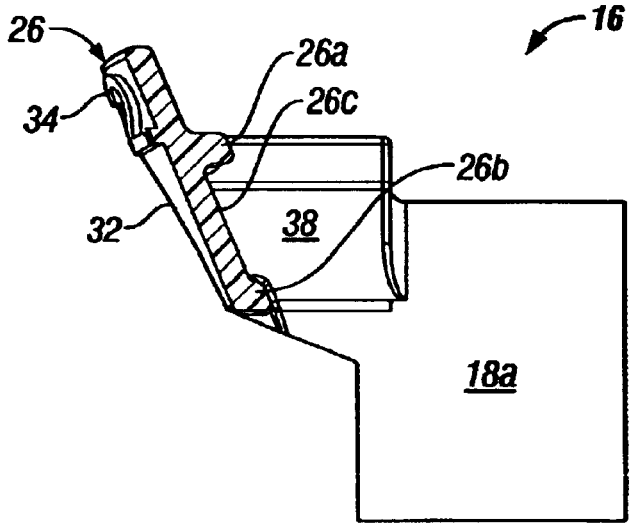
FIG. 8 is a longitudinal sectional view of the nozzle taken along line 8—8 of FIG. 7 illustrating further details thereof.

The pry flange 26 (FIG. 7) extends from the outer end of the right stabilizing arm 38. The nozzle receiving socket 14 has an outer segment 14*c* (FIG. 4) divided into two opposite halves that are configured to receive the stabilizing arms 36 and 38. The circumferentially spaced outer segment 14*b* is configured to receive the pry flange 26. The distance between the outermost walls first outer segment 14*c* of the nozzle receiving socket 14 is slightly less than the distance between the outer walls of the stabilizing arms 36 and 38. The stabilizing arms 36 and 38 are thus slightly compressed toward one another when the nozzle 16 is inserted into the nozzle receiving socket 14. The springy resilience of the plastic stabilizing arms 36 and 38 helps to hold the nozzle 16 in position within the nozzle receiving socket 14 until the screw 42 is threaded out of the recess 40. The pry flange 26 has overhanging upper and lower lips 26*a* and 26*b* that extend in the circumferential (lateral) direction. The lips 26*a* and 26*b* bracket the lower portion 32 of the pry flange and facilitate engagement and lifting of the pry flange 26 with a hand tool. When the end of the rod of the HUNTER tool or some other tool is inserted in the gap 30 it can engage the rear side 26*c* (FIGS. 8 and 9) of the lower portion 32 of the pry flange 26. The upper end of the tool can then be pushed downwardly so that a portion of the rod or screwdriver shaft just above the end thereof engages the shoulder at the outer end of the side wall 28 (FIG. 3) of the nozzle receiving socket 14. The overhanging lips 26*a* and 26*b* help to keep the tip of the tool centered in the gap 30 in the optimum position for maintaining positive contact with the lower portion 32 of the pry flange 26 for prying out the nozzle 16. The maximum circumferential or lateral width of the lower portion 32 of the pry flange 26 is preferably approximately equal to the circumferential or lateral width of the gap 30, as best seen in FIG. 1. The lower portion 32 should have a width of at least one-third the width of the gap 30 to provide sufficient surface area on the rear side 26*c* to ensure positive engagement with the tool.

Users can intuitively understand that they should insert a tool into the gap 30 (FIG. 1) to pop the nozzle 16 out of the nozzle receiving socket 14. The tool can be used to quickly pry the nozzle 16 out of the nozzle receiving socket 14, without any risk of damage to the nozzle 16 so that it can unclogged and re-inserted. There is also no danger of damaging the nozzle receiving socket 14. My invention also allows the user to readily replace the nozzle 16 with a nozzle having an identical outer configuration but a different size and/or shape of nozzle orifice 24 to alter the precipitation rate and/or radius of the sprinkler.

The head 10 (FIG. 1) is connected to a tubular central drive shaft 46 (FIG. 2). The drive shaft 46, and thus the head 10 and the nozzle 16 supported therein, are rotated about a vertical axis 47 by an internal turbine and gear reduction drive (not illustrated) through a predetermined arc utilizing an over-center third spring reversing mechanism (not illustrated) and an arc limit tab 48 that is adjustable with the HUNTER tool. The end of the hexagonal rod of the HUNTER tool is inserted into a hex socket in the upper end of a shaft 50 that extends vertically through a cylindrical sleeve 52 (FIG. 4) molded into the head 10. A geared lower end of the shaft 50 engages and rotates a bull gear 54 (FIG. 2). The bull gear 54 is rigidly mounted to the upper end of a cylindrical sleeve 56 that surrounds the drive shaft 46. The lower end of the cylindrical sleeve 56 carries the adjustable arc tab limit 48 that trips the reversing mechanism. For further details see U.S. Pat. No. 3,107,056 granted Oct. 15, 1963 to Edwin J. Hunter and U.S. Pat. No. 4,568,024 granted Feb. 4, 1986 to Edwin J. Hunter, the entire disclosures of which are hereby incorporated by reference.

The head 10 is mounted at the top end of a cylindrical hollow riser (not illustrated) that vertically reciprocates in telescopic fashion upwardly within a cylindrical outer housing (not illustrated) through the upper end thereof under the force of water pressure and retracts under the force of a coil spring (not illustrated). The turbine, gear reduction drive and reversing mechanism are contained within the riser. The lower end of the outer housing has a female threaded inlet that is screwed over a male threaded fitting on a pressurized water supply line.

Figure 10:
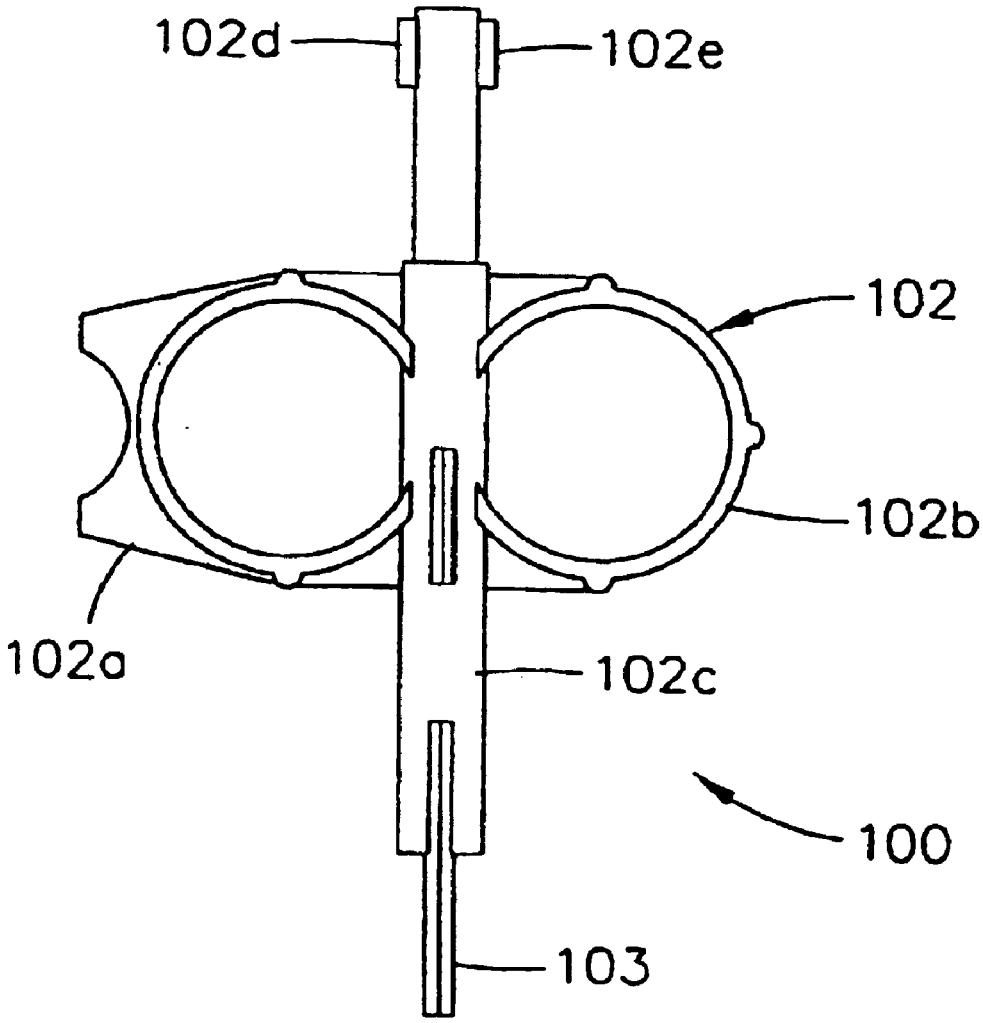
FIG. 10 is an elevation view of a tool that may be used to remove the nozzle from the head of the sprinkler illustrated in FIG. 1.

FIG. 10 illustrates details of an arc adjustment tool 100 that may be used to remove the nozzle 16 from the nozzle receiving socket 14. The tool 100 includes a molded plastic portion 102 and a metal rodportion 104. The plastic portion 102 includes apair of finger rings 102*a* and 102*b* formed on opposite sides of a central support sleeve 102*c*. An upper end of the support sleeve 102*c* surrounds and holds a majority of the metal rod 104. The plastic portion 102 further includes a pair of small rectangular flanges 102*d* and 102*e* that extend from opposite sides of the lower end of the support sleeve 102*c*.

While I have described preferred embodiments of my novel sprinkler and easy removal nozzle, it will be apparent to those skilled in the art that my invention may be modified in both arrangement and detail. For example, my invention is not limited to use with rotor type irrigation sprinklers but could be used with any sprinkler that is designed to provide different pre-selected rates of precipitation and/or radii and has a head in which a nozzle receiving socket can be provided. The precise configuration of the nozzle itself can be widely varied to suit the particular needs of a given irrigation sprinkler. Therefore, the protection afforded my invention should only be limited in accordance with the scope of the following claims.

I claim:

1. An irrigation sprinkler comprising:

a head having a first water outlet passage communicating with a nozzle receiving socket;

a nozzle slidably mounted in the nozzle receiving socket and including a hollow support body defining a second water outlet passage communicating with the first water outlet passage, a portion defining a nozzle orifice, and a cantilevered pry flange extending in a lateral direction from an outer end of the support body and having a portion terminating short of a wall of the nozzle receiving socket to create a gap sized for ready insertion of a tool to facilitate removal of the nozzle from the nozzle receiving socket, the nozzle further including a pair of spaced apart stabilizing arms that extend in a forward direction from opposite sides of the support body and define a recess for receiving a screw that holds the nozzle in the nozzle receiving socket; and a tubular drive shaft for supplying the first water outlet passage of the head with pressurized water.

2. The sprinkler of claim 1 wherein the pry flange has an exterior surface bearing indicia representing a precipitation rate corresponding to a size of the nozzle orifice.

3. The sprinkler of claim 1 wherein the nozzle receiving socket has a region with a configuration complementary to the pry flange for receiving and surrounding the pry flange.

4. The sprinkler of claim 1 wherein the support body has a cylindrical shape and the portion defining the nozzle orifice is a flat wall extending across and obstructing the second water outlet passage.

5. The sprinkler of claim 1 wherein the pry flange extends from an outer end of one of the stabilizing arms.

6. The sprinkler of claim 5 wherein the support body has a cylindrical shape and the nozzle receiving socket has an inner cylindrical segment for receiving the support body.

7. The sprinkler of claim 6 wherein the nozzle receiving socket has a first outer segment configured to receive the stabilizing arms and a second outer segment configured to receive the pry flange.

8. The sprinkler of claim 1 wherein the pry flange has at least one overhanging lip to facilitate engagement and lifting of the pry flange with a tool.

9. An easy removal nozzle for an irrigation sprinkler having a head with a first water outlet passage communicating with a nozzle receiving socket, comprising:

a hollow support body configured to be slidably mounted in the nozzle receiving socket and defining a second water outlet passage communicating with the first water outlet passage, the support body including a pair of spaced apart stabilizing arms that extend in a forward direction from opposite sides of the support body and define a recess for receiving a screw that holds the nozzle in the nozzle receiving socket;

a wall portion obstructing the second water passage and defining a nozzle orifice; and a cantilevered pry flange extending in a lateral direction from an outer end of the support body and having a portion terminating short of a wall of the nozzle receiving socket to create a gap sized for ready insertion of a tool to facilitate removal of the nozzle from the nozzle receiving socket.

10. The nozzle of claim 9 wherein the pry flange has an exterior surface bearing indicia representing a precipitation rate corresponding to a size of the nozzle orifice.

11. The nozzle of claim 9 wherein the nozzle receiving socket has a region with a configuration complementary to the pry flange for receiving and surrounding the pry flange.

12. The nozzle of claim 9 wherein the support body has a portion with a cylindrical shape and the portion obstructing the second water passage and defining a nozzle orifice is a flat wall extending across the second water outlet passage.

13. The nozzle of claim 9 wherein the pry flange extends from an outer end of one of the stabilizing arms.

14. The nozzle of claim 13 wherein the support body has a portion with a cylindrical shape and the nozzle receiving socket has an inner cylindrical segment for receiving the cylindrical portion of the support body.

15. The nozzle of claim 14 wherein the nozzle receiving socket has a first outer segment configured to receive the stabilizing arms and a second outer segment configured to receive the pry flange.

16. The nozzle of claim 9 wherein the pry flange has an overhanging lip that extends in the lateral direction to facilitate engagement and lifting of the pry flange with a tool.

* * * * *